US006273427B1

(12) United States Patent
Simmons et al.

(10) Patent No.: US 6,273,427 B1
(45) Date of Patent: Aug. 14, 2001

(54) REFRIGERATION SEALING SYSTEM FOR A REFRIGERATION UNIT

(75) Inventors: Darren W. Simmons, San Antonio; John Thomas Hawkins, Jr., Adkins, both of TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 09/334,519

(22) Filed: Jun. 16, 1999

(51) Int. Cl.[7] ..... F16L 55/11

(52) U.S. Cl. ..... 277/314; 277/312; 277/316; 277/630; 277/933; 138/89; 138/94

(58) Field of Search ..... 277/312, 314, 277/316, 602, 630, 931, 933; 138/89, 94

(56) References Cited

U.S. PATENT DOCUMENTS 5,890,375 * 4/1999 Stahl ..... 62/511
5,988,223 * 11/1999 Kanzaki et al. ..... 138/89
6,098,657 * 8/2000 Sugg ..... 137/546

* cited by examiner

*Primary Examiner*—Chuck Y. Mah
*Assistant Examiner*—Enoch E. Peavey
(74) *Attorney, Agent, or Firm*—Christopher L. Makay

(57) ABSTRACT

A refrigeration sealing system for a refrigeration unit includes a trap-process tube coupled with and in communication with a compressor of the refrigeration unit for receiving refrigerant from a refrigerant source. The trap-process tube defines a passageway through which refrigerant flows from the refrigerant source to the compressor. The refrigeration sealing system for a refrigeration unit further includes an annular plug disposed within the passageway. The annular plug defines a bore for facilitating the flow of refrigerant through the passageway. The annular plug is further deformable to seal the passageway of the trap process tube.

15 Claims, 2 Drawing Sheets

REFRIGERATION SEALING SYSTEM FOR A REFRIGERATION UNIT

BACKGROUND OF THE INVENTION

1. Field of the Invention

The present invention generally relates to refrigeration units and, more particularly, but not by way of limitation, to a refrigeration sealing system for sealing refrigerant within a compressor that favorably diminishes the potential for leaks.

2. Description of the Related Art

Beverage dispensers include cooling systems for cooling beverage fluids, such as a diluent of plain water or carbonated water and beverage flavored syrup, prior to forming and dispensing a desired beverage in that it is highly desirable in the industry to serve carbonated drinks at the coldest temperature possible. Some cooling systems include refrigeration units for cooling beverage fluids.

Refrigeration units include a refrigeration line whereby refrigerant flows therethrough. Refrigerant is pumped through the refrigeration line via a compressor provided by the refrigeration unit. To thus cool beverage fluids, thermal energy is transferred from warm beverage fluids to the cool refrigerant.

FIG. 1*a* is a related art illustration depicting the current refrigeration charging process. As such, a prior art refrigeration sealing system 2 is secured to a compressor 5 using any suitable means. The prior art refrigeration sealing system 2 includes a process tube 30 coupled with and in communication with the compressor 5. Process tube 30 defines a passageway 39 where refrigerant flows therethrough.

During the refrigerant charging process, new refrigerant is dispensed from a refrigerant charging conduit 10 in communication with the process tube 30. The refrigerant charging conduit 10 in turn is coupled with and receives refrigerant from a refrigerant source 6. Refrigerant thus flows from the refrigerant charging conduit 10 across the process tube 30 into the compressor 5. Accordingly, the refrigerant charging process continues until compressor 5 receives a sufficient amount of refrigerant.

Inasmuch, FIG. 1*b* is a prior art illustration depicting the process for sealing refrigerant within the compressor 5. The prior art refrigeration sealing system 2 includes a crimp 37 formed by the process tube 30 and disposed thereon. Crimp 37 enables the process tube 30 to close off passageway 39, thereby sealing refrigerant within the compressor 5. In addition, the prior art refrigeration sealing system 2 includes a sealing plug 35 disposed within passageway 29 for sealing refrigerant within the compressor 5. Sealing plug 35 is a standard sealing plug used in the industry and is composed of solder material.

Unfortunately, the prior art refrigeration sealing system 2 does not favorably diminish the potential for leaks. This current sealing process, however is not satisfactory. As such, although sealed within the compressor, refrigerant often leaks from the refrigeration unit. Crimping process tube 30 often causes stress fractures along crimp 37 allowing for refrigerant to leak out. Similarly, refrigerant can leak from gaps provided between sealing plug 35 and passageway 39 in that sealing plug 35 fails to satisfactorily close off passageway 39.

Accordingly, there is a long felt need for a refrigeration sealing system for sealing refrigerant within a compressor that favorably diminishes the potential for leaks.

SUMMARY OF THE INVENTION

In accordance with the present invention, a refrigeration sealing system for a refrigeration unit includes a trap-process tube coupled with and in communication with a compressor of the refrigeration unit for receiving refrigerant from a refrigerant source. The trap-process tube defines a passageway through which refrigerant flows from the refrigerant source to the compressor. The refrigeration sealing system for a refrigeration unit further includes an annular plug disposed within the passageway. The annular plug defines a bore for facilitating the flow of refrigerant through the passageway. The annular plug is further deformable to seal the passageway of the trap process tube.

A method for sealing refrigerant within a refrigeration unit, includes the steps of coupling a trap-process tube with a compressor of the refrigeration unit, whereby the trap-process tube is in communication with the compressor; passing refrigerant from the refrigerant source to the compressor through the trap-process tube, wherein the trap-process tube defines a passageway through which refrigerant flows from the refrigerant source to the compressor; and closing off the passageway so that refrigerant is sealed within the refrigeration unit.

The step of passing refrigerant from the refrigerant source to the compressor through the trap-process tube includes the steps of positioning an annular plug within the passageway and passing refrigerant through a bore defined by the annular passageway. The step of closing off the passageway so that refrigerant is sealed within the refrigeration unit includes the steps of forming a sealing slug for sealing the passageway and positioning the sealing slug within the passageway, thereby sealing the passageway. The step of forming a sealing plug for sealing the passageway includes the steps of deforming the annular plug, collecting deformed material from the annular plug within the passageway, and hardening the deformed material, thereby forming the sealing slug.

It is therefore an object of the present invention to provide a refrigeration sealing system for sealing refrigerant within a compressor that favorably diminishes the potential for leaks.

Still other objects, features, and advantages of the present invention will become evident to those skilled in the art in light of the following.

BRIEF DESCRIPTION OF THE DRAWINGS

FIG. 1 illustrates a prior art refrigeration sealing system for sealing refrigerant within a compressor.

FIG. 2 illustrates a refrigeration sealing system for sealing refrigerant within a compressor according to the preferred embodiment.

FIG. 2*aa* is a detailed view of an annular plug that is disposed within the trap-process tube during the refrigerant charging process.

DETAILED DESCRIPTION OF THE PREFERRED EMBODIMENT

As required, detailed embodiments of the present invention are disclosed herein, however, it is to be understood that the disclosed embodiments are merely exemplary of the invention which may be embodied in various forms, the figures are not necessarily to scale, and some features may be exaggerated to show details of particular components or steps.

Refrigerant must be periodically changed to ensure optimal thermal efficiency of a refrigeration unit (not shown). In particular, used refrigerant is removed from a compressor 5 which is provided by the refrigeration unit for delivering refrigerant across the refrigeration unit, in exchange for new refrigerant. It should be added that the refrigeration unit is a standard refrigeration unit used in the industry.

Figure 1A:
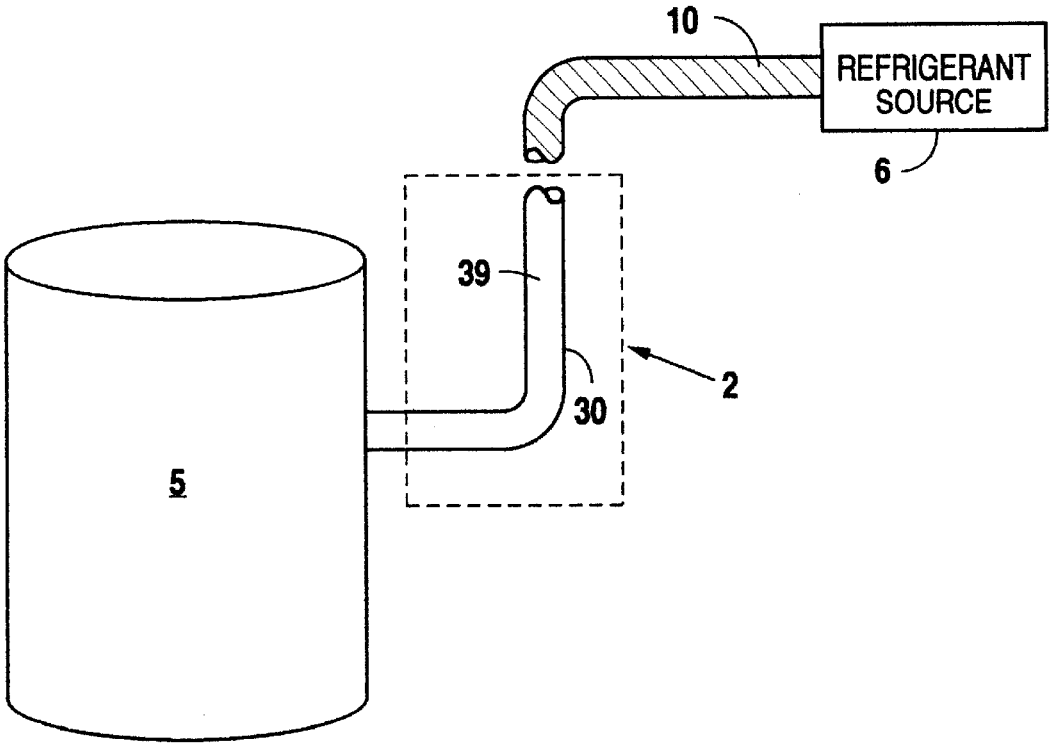
FIG. 1*a* is a side view illustrating the refrigerant charging process whereby a compressor receives refrigerant from a refrigerant charging conduit via a process tube.
Figure 1B:
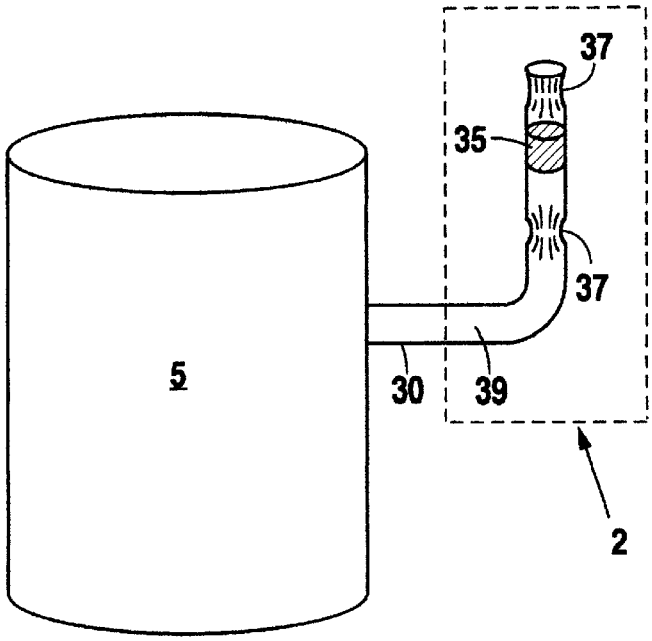
FIG. 1*b* is a side view illustrating the process for sealing refrigerant within the compressor y crimping the process tube and filling the tube with solder.
Figure 2A:
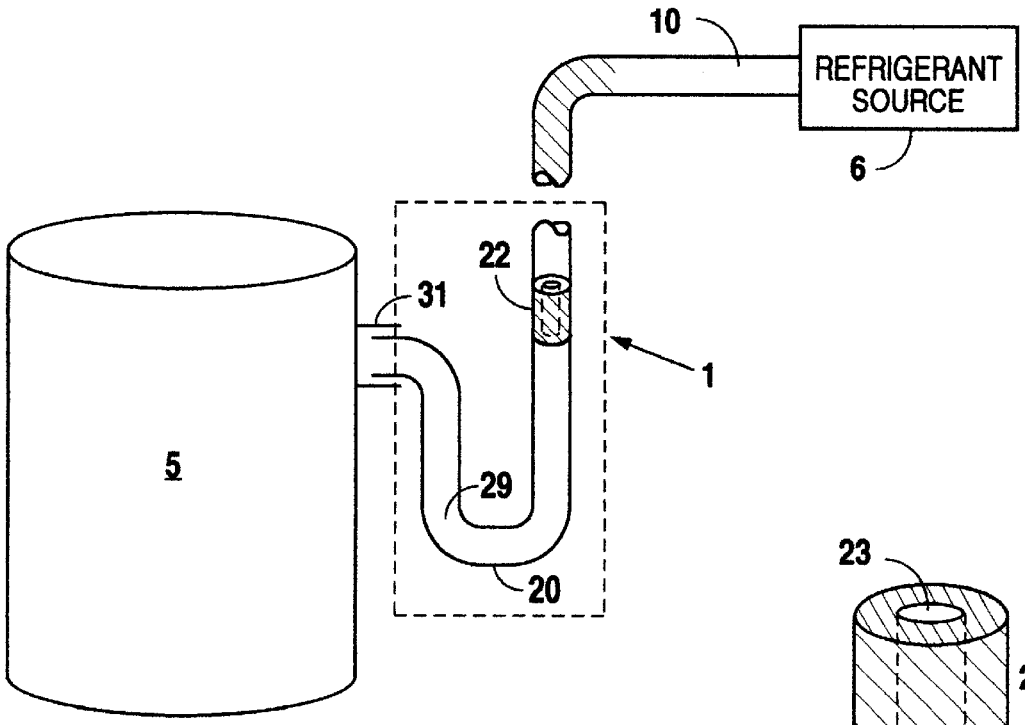
FIG. 2*a* is a side view illustrating the refrigerant charging process whereby a compressor receives refrigerant from a refrigerant charging conduit via a trap-process tube.
Figure 2A:
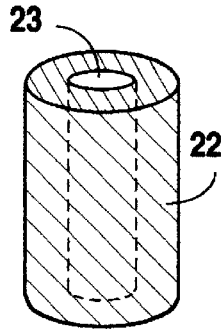

FIG. 2 illustrates a refrigeration sealing system I for sealing refrigerant within a compressor 5 that favorably diminishes the potential for leaks. The refrigeration sealing system 1 includes a trap-process tube 20 coupled with and in communication with the compressor 5. In the preferred embodiment, trap-process tube 20 is secured to an inlet 31 defined by the compressor 5 to facilitate easy removal and replacement of the refrigeration sealing system 1, especially during maintenance and repair of a refrigeration unit. Trap-process tube 20 defines a passageway 29 through which refrigerant flows.

The refrigeration sealing system 1 includes an annular plug 22 disposed within passageway 29 during the refrigerant charging process. As shown in FIG. 2*aa*, annular plug 22 defines a bore 23 for facilitating the flow of refrigerant through passageway 29. In the preferred embodiment, annular plug 22 is composed of any readily deformable material, such as solder, plastic, or resin.

During the refrigerant charging process, as shown in FIG. 2*a*, new refrigerant is dispensed from a refrigerant charging conduit 10 in communication with the trap-process tube 20. The refrigerant charging conduit 10 in turn is coupled with and receives refrigerant from a refrigerant source 6. Refrigerant thus flows from the refrigerant charging conduit 10, across the trap-process tube 20, through annular plug 22 disposed within the trap-process tube 20, into the compressor 5. Accordingly, the refrigerant charging process continues until compressor 5 receives a sufficient amount of refrigerant.

Figure 2B:
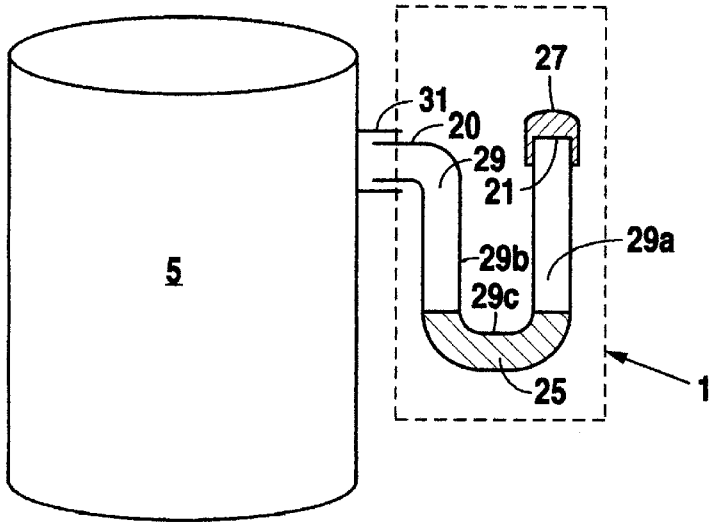
FIG. 2*b* is a side view illustrating the process for sealing refrigerant within the compressor by deforming the annular plug and capping the trap-process tube.

FIG. 2*b* illustrates the preferred process for sealing refrigerant within the compressor 5 by deforming the annular plug 22 and capping the trap-process tube 20. The refrigeration sealing system I includes a sealing slug 25 disposed within passageway 29 formed from the annular plug 22. The sealing slug 25 seals refrigerant within the compressor 5 by sufficiently closing off passageway 29 after the refrigerant charging process.

The refrigeration sealing system 1 further includes a bend 29*a–c* formed by the trap-process tube 29. Bend 29*a–c* includes a first end 29*a*, a second end 29*b*, and a trough 29*c* interposed with and linking the first end 29*a* and the second end 29*b*. It is essential that the first end 29*a* and the second end 29*b* are each substantially perpendicular to the trough 29*c* to provide a "trap" for deformed material from annular plug 29 to collect and thus form sealing slug 25.

As such, in the preferred embodiment. sealing slug 25 extends from trough 29*c* to the first end 29*a* and the second end 29*b*. Forming sealing slug 25 in the preferred maimer greatly diminishes the potential for forming gaps between sealing slug 25 and passageway 29, whereby it is well known that refrigerant leaks through such gaps. Moreover, by positioning sealing slug 25 within a trap, refrigerant is altogether less likely to travel past the sealing slug 25. While within a trap, as dictated by fluid mechanics, refrigerant must travel with great difficulty against the forces of gravity along a perpendicular. In sum, forming the sealing slug 25 in bend 29*a–c* eliminates the formation of gaps and applies a gravitational force against fluid flow thereby stopping the flow of refrigerant through passageway 29.

The refrigeration sealing system 1 includes a cap 27 disposed on inlet 21 of trap-process tube 20 for sealing passageway 27. Cap 27 is secured to trap-process tube 20 using any suitable securing means. In the preferred embodiment, cap 27 provides a permanent seal for passageway 29.

Therefore, once compressor 5 receives a sufficient amount of refrigerant, annular plug 22 is allowed to deform, such as through the application of heat or ultrasonic means, so that material from annular plug 22 collects along bend 29*a–c*. Once a sufficient amount is collected in bend 29*a–c*, the material from annular plug 22 is allowed to harden, thereby forming sealing slug 25. Sealing slug 25 thus closes off passageway 29 to prevent the flow of refrigerant therethrough. Furthermore, cap 27 is secured to the trap-process tube 20 to permanently seal passageway 29.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. A refrigeration sealing system for a refrigeration unit, comprising:

a trap-process tube coupled with and in communication with a compressor of the refrigeration unit for receiving refrigerant from a refrigerant source, the trap-process tube defining a passageway through which refrigerant flows from the refrigerant source to the compressor; and a plug disposed within the passageway, the plug defining a bore permitting the flow of refrigerant through the passageway, whereby the plug deforms into a sealing slug that seals the passageway of the trap process tube.

2. The refrigeration sealing system according to claim 1 further comprising a bend formed by the trap-process tube.

3. The refrigeration sealing system according to claim 2 wherein the bend collects material from the plug thereby forming the sealing slug.

4. The refrigeration sealing system according to claim 2 wherein the bend includes a first end, a second end, and a trough interposed with and linking the first end and second end.

5. The refrigeration sealing system according to claim 4 wherein the first end is substantially perpendicular to the trough.

6. The refrigeration sealing system according to claims 4 or 5 wherein the second end is substantially perpendicular to the trough.

7. The refrigeration sealing system according to claim 1 further comprising a cap disposed on the trap-process tube for sealing refrigerant within the refrigeration unit.

8. The refrigeration sealing system according to claim 7 wherein the cap provides a permanent seal for the passageway.

9. The refrigeration sealing system according to claim 1 wherein the compressor defines an inlet, whereby the trap-process tube is coupled with the inlet to facilitate easy removal of the refrigeration sealing system.

10. A method for sealing refrigerant within a refrigeration unit, comprising the steps of:

coupling a trap-process tube with a compressor of the refrigeration unit, whereby the trap-process tube defines a passageway communicating with the compressor;

positioning a plug within the passageway of the trap-process tube, whereby the plug defines a bore permitting the flow of refrigerant through the passageway;

passing refrigerant from refrigerant source to the compressor through the passageway of the trap-process tube; and deforming the plug into a sealing slug that seals the passageway of the trap process tube.

11. The method according to claim 10 wherein the step of coupling a trap-process tube with the compressor further comprises the step of coupling a trap-process tube with an inlet formed by the compressor to facilitate easy removal of the refrigeration sealing system.

12. The method according to claim 10 wherein the step of deforming the plug into a sealing plug that seals the passageway of the trap process tube further comprises the steps of:

collecting deformed material from the plug within the passageway; and hardening the deformed material, thereby forming the sealing slug.

13. The method according to claim 12 wherein the deformed material is collected within a bend provided by the trap-process tube.

14. The method according to claim 10 further comprising the step of securing a cap to the trap-process tube for sealing refrigerant.

15. The method according to claim 14 wherein the cap provides a permanent seal for the passageway.

* * * * *